US006432909B1

(12) United States Patent
Srinivas et al.

(10) Patent No.: US 6,432,909 B1
(45) Date of Patent: Aug. 13, 2002

(54) WATER SOLUBLE DYE COMPLEXING POLYMERS

(75) Inventors: Bala Srinivas, Hasbrouck Heights; Jenn S. Shih, Paramus; David E. Graham; Michael A. Drzewinski, both of Long Valley, all of NJ (US)

(73) Assignee: ISP Investments Inc., Wilmington, DE (US)

( * ) Notice: Subject to any disclaimer, the term of this patent is extended or adjusted under 35 U.S.C. 154(b) by 118 days.

(21) Appl. No.: 09/636,659

(22) Filed: Aug. 11, 2000

(51) Int. Cl.[7] ..... C11D 3/28

(52) U.S. Cl. ..... 510/499; 510/276; 510/499; 510/500

(58) Field of Search ..... 510/276, 499, 510/500

(56) References Cited

FOREIGN PATENT DOCUMENTS

WO 97/42931 * 11/1997

* cited by examiner

*Primary Examiner*—Charles Boyer
(74) *Attorney, Agent, or Firm*—Walter Katz; William J. Davis; Marilyn J. Maue

(57) ABSTRACT

This invention relates to dye complexing polymers, and, more particularly, to water soluble poly (isopropenylpyridine) betaines containing a quaternary nitrogen and a carboxylate salt or carboxylic acid group. The polymers herein have effective dye complexing properties for use, for example, laundry detergent and fabric softener compositions.

27 Claims, No Drawings

WATER SOLUBLE DYE COMPLEXING POLYMERS

BACKGROUND OF THE INVENTION

1. Field of the Invention

This invention relates to dye complexing polymers, and, more particularly, to water soluble poly (isopropenylpyridine) betaines containing a quaternary nitrogen and a carboxylate salt or carboxylic acid group. The polymers herein have effective dye complexing properties for use, for example, laundry detergent and fabric softener compositions.

2. Description of the Prior Art

Dye complexing polymers have been used in laundry detergent and fabric softener compositions. In such application, during washing a mixture of colored and white fabrics, some of the dyes may bleed out of a colored fabric under washing conditions. The degree of bleeding is influenced by the structure of the dye, the type of cloth and the pH, temperature and mechanical efficiency of the agitation process. The bled dye in the wash liquor can be totally innocuous and get washed off in the wash liquor. However, in reality, this fugitive dye has a tendency to redeposit, either onto the same fabric or onto another fabric leading to patches and an ugly appearance of the washed material. This redeposition of the bled dye can be inhibited in several ways. One method is to introduce compounds which can complex with the fugitive dye and get washed off thus preventing redeposition.

Polyvinylpyrrolidone (PVP), by virtue of its dye complexation ability, has been used to inhibit dye deposition during washing of colored fabrics under laundry conditions. The performance of PVP as a DTI, however, is adversely affected by the presence of anionic surfactants in the washing process.

Other polymers which have been used as DTIs in laundry detergent compositions include polyvinylpyridine N-oxide (PVPNO); polyvinylimidazole (PVI) and copolymers of polyvinylpyridine and polyvinylimidazole (PVP-PVI).

U.S. Pat. Nos. 5,776,879; 5,929,175; 5,8619,442; 5,863,880, assigned to the same assignee as herein are related to this invention.

The other prior art in this field is represented by the following patents and publications:

| Patent | Subject Matter |
|---|---|
| (1) JP 53-50732 | Formulas Nos. 3, 6 and (1) are water insoluble compounds and polymers used in printing ink compositions; |
| (2) PCT/US94/06849 WO 95/03390 | Dye inhibiting composition polymers of PVP, polyamine N-oxide, vinylimidazole are used in laundry detergent compositions; |
| (3) U.S. Pat. No. 5,460,752 | Polyamine N-oxide polymers described for use in laundry detergent compositions; |
| (4) EPA 664335 A1 | Polysulfoxide polymers; |
| (5) PCT/US93/10542 WO 94/11473 | Laundry compositions include polyamine-N-oxide and brighteners and surfactants; |
| (6) PCT/EP93/02851 WO 94/10281 | PVP and PVI are present in laundry compositions; |
| (7) PCT/US94/11509 WO 95/13354 | Poly(4-vinylpyridine-N-oxide) (PVNO) and copolymers of VP and VI are described; |

-continued

| Patent | Subject Matter |
|---|---|
| (8) EP 754748 A1 | Vinylpyridine copolymers and formic acid; |
| (9) 066433 A1 | Polyamine oxide polymers; |
| (10) U.S. Pat. No. 5,604,197 | PVPNO + clay softening; |
| (11) U.S. Pat. No. 5,458,809 | PVPNO; |
| (12) U.S. Pat. No. 5,466,802 | PVPNO and PVP-VI; |
| (13) U.S. Pat. No. 5,627,151 | Copolymers of VP or VI; vinylpyridine or dimethylaminoethyl methacrylate or dimethylaminopropylmethacrylamide, including up to 20% vinylacetate; |
| (14) PCT/US95/04019 WO 95/27038 | PVPNO, PVP, PVP-PI and copolymers of VP and VI; |
| (15) EPA 628624 A1 | PVPNO with protease; |
| (16) DE 4224762 A1 | VP polymers; |
| (17) J. Polymer Sci. 26, No. 113, p. 25–254 (1957) | Water-insoluble poly(4-vinylpyridine) compounds and polymers |

Accordingly, it is an object of this invention to provide new and improved water soluble dye complexing polymers.

Another object herein is to provide water soluble dye complexing polymers which are effective in laundry detergent compositions containing an anionic surfactant.

A feature of the invention is the provision of a water soluble poly(isopropenylpyridine) betaine containing a quaternary nitrogen and a carboxylate salt or carboxylic acid group.

Another feature of the invention is the provision of laundry detergent compositions containing such new and improved water soluble polymers, which exhibit color stability during storage, and particularly effective dye complexing properties during the washing process even in the presence of anionic surfactants.

Among the other objects and features of the invention is to provide such polymers having dye complexing properties useful in fabric softener and textile dye treatment compositions.

SUMMARY OF THE INVENTION

What is described herein is a water soluble poly (isopropenylpyridine betaine) polymer which contains a quaternary nitrogen and a carboxylate salt or carboxylic acid group. The polymer has the formula:

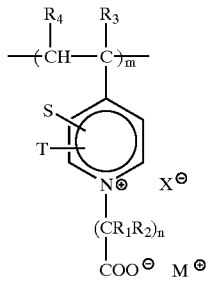

where m is indicative of the degree of polymerization;

X is an anion;

$R_1$ and $R_2$ are independently hydrogen, alkyl or aryl;

$R_3$ and $R_4$ are independently hydrogen or alkyl, with the proviso that at least one is alkyl;

n is 1–5;

M is a cation or H; and

S and T are each independently hydrogen or alkyl.

Preferred embodiments of the invention are polymers in which X is a halide; most preferably chloride or bromide; $R_1$ and $R_2$ are both hydrogen; $R_3$ is alkyl, preferably methyl and $R_4$ is hydrogen, n is 1; M is an alkali metal or H; preferably sodium or potassium; and the polymer is 25–100% quaternized; most preferably 75–100%; and S and T are both hydrogen.

A preferred polymer has a weight average molecular weight of about 5,000 to 1,000,000; preferably 20,000 to 200,000, where m is about 30–5000, preferably 100–1000. Water soluble copolymers of the defined polymer above with polymerizable comonomers, such as vinyl pyrrolidone, vinyl imidazole, acrylamide and vinyllcaprolactam also are useful herein.

The polymers of the invention have effective dye complexing properties for use in laundry detergent compositions which include at least 1% by weight of an anionic, cationic or non-ionic surfactant or mixtures thereof.

DETAILED DESCRIPTION OF THE INVENTION

In accordance with the invention, there is described herein a water soluble poly(isopropenylpyridine) betaine containing a quaternary nitrogen and a carboxylate salt or carboxylic acid group. This polymer has dye complexing properties, particularly for use in laundry applications, having the formula:

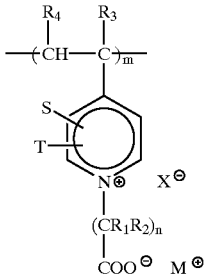

where m is indicative of the degree of polymerization;

X is an anion;

$R_1$ and $R_2$ are independently hydrogen, alkyl or aryl;

$R_3$ and $R_4$ are independently hydrogen or alkyl with the proviso that at least one is alkyl;

n is 1–5;

M is a cation or H; and

S and T are independently hydrogen or alkyl.

Preferred embodiments of the invention are polymers in which X is a halide; most preferably chloride or bromide; $R_1$ and $R_2$ are both hydrogen; $R_3$ is alkyl, preferably methyl and $R_4$ is hydrogen; n is 1; M is an alkali metal or H; preferably sodium or potassium; and the polymer is 25–100% quaternized; most preferably 75–100%; and S and T are both hydrogen.

A preferred polymer has a weight average molecular weight of about 5,000 to 1,000,000; preferably 20,000 to 200,000, where m is about 30–5000, preferably 100–1000. Water soluble copolymers of the defined polymer above with polymerizable comonomers, such as vinyl pyrrolidone, vinyl caprolactam, vinyl imidazole, N-vinyl formamide, and acrylamide also are useful herein.

A preferred use of the polymer and copolymers herein is in laundry detergent compositions which includes about. 0.01–10% of the polymer or copolymer, which will provide about 2–1000 ppm of the polymer or copolymer during laundry use.

In a preferred embodiment of the invention, the water soluble polymers of the invention are made by polymerizing a suitable isopropenylpyridine under suitable polymerization conditions to form a poly(isopropenylpyridine) intermediate, and then reacting the intermediate polymer with sodium chloroacetate in an aqueous medium. The reaction product is a poly(isopropenylpyridine) betaine polymer containing a quaternary nitrogen and a carboxylate salt or carboxylic acid group.

In the polymerization step, which may be solution, precipitation or emulsion polymerization, any suitable solventlimay be used, for example, an alcohol, such as methanol, ethanol or isopropanol; water; or mixtures of water and alcohol. The reaction temperature is about 40° to 150° C., preferably 50° to 90° C., and most preferably about 60° to 85° C. The polymerization initiator is a free radical initiator, such as perester, peroxide, percarbonate, or Vazo® type initiators may be used. The polymerization is carried out at a solids level of about 5 to 80%, preferably 20 to 50%.

A preferred polymer* herein is poly(4-isopropenylpyridine) sodium carboxymethyl betaine chloride having the formula:

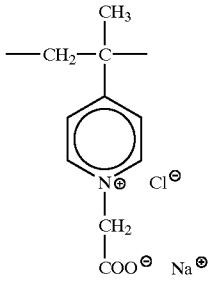

The invention will now be illustrated by the following examples, in which:

EXAMPLE 1

Poly(4-Isopropenylpyridine)

Into a 1-liter, 4-necked resin kettle, fitted with a stainless steel anchor agitator, a nitrogen purge adapter and a reflux condenser, a mixture of 160 g of 4-isopropenylpyridine monomer and 440 g of isopropanol are charged. The nitrogen purge is begun and continued throughout the experiment. The above mixture at ambient temperature is then gradually heated to 75° C. and held for 30 minutes. Then 2.0 g of t-butylperoxypivalate is charged while operating the agitator at 350 rpm. The mixture is kept at 75° C. throughout the resin. The resulting mixture is agitated for one hour. Then 0.5 g of Lupersol®11 is added every hour until the residual 4-isopropenylpyridine level is less than 0.5%.

EXAMPLE 2

Poly(4-Isopropenylpyridine)

Into a 1-l, 4-necked resin kettle, fitted with glass anchor agitator, a nitrogen purge adapter and a reflux condenser, a mixture of 100 g of 4-isopropenylpyridine monomer and 250 g of ethanol are charged. The nitrogen purge is begun and continued throughout the experiment. The above mixture at ambient temperature is then gradually heated to 75° C. and held for 30 minutes. 2.0 grams of initiator t-butylperoxy pivalate is charged while operating the anchor agitator at 300 rpm. The mixture is kept at 75° C. throughout the experiment. The mixture is continued for one hour; after which 0.5 g of Lupersol 11 is added every hour until the residual 4-isopropenyl pyridine ievel is less than 0.5%.

EXAMPLE 3

Poly(Isopropenylpyridine)

Into a 1-l, 4-necked resin kettle, fitted with a stainless steel anchor agitator, a nitrogen purge adapter and a reflux condenser, a mixture of 60 g of 4-isopropenylpyridine monomer, 3.0 g of K-30 poly(4-vinylpyrrolidone) and 240 g of water are charged. The nitrogen purge is begun and continued throughout the experimrent. The above mixture at ambient temperature is then gradually heated, and held at 85° C. for 30 minutes while operating the anchor agitator at 350 rpm. An initial charge of 1.0 g of t-butyl peroxypivalate (Lupersol 11) is added to the mixture and agitation was continued for one hour; after which 0.5 g of Lupersol 11 is added every hour over an 8-hour period until the residual 4-isopropenyridine level is less than 0.5%. The resulting poly(4-isopropenylpyridine) is recovered by filtering and drying in an 80% yield.

EXAMPLE 4

Poly(4-Isopropenylpyridine)

Into a 1-l, 4-necked resin kettle, fitted with a stainless steel anchor agitator, a nitrogen purge adapter and a reflux condenser, a mixture of 60 g of 4-isopropenylpyridine monomer, 0.6 g of hydroxyethyl cellulose and 240 g of water are charged. The nitrogen purge is begun and continued throughout the experiment. The above mixture at ambient temperature is then gradually heated and held at 90° C. for 30 minutes while operating the anchor agitator at 350 rpm. An initial charge of 1.0 g of t-butyl peroxypivalate (Lupersol 11) is added to the mixture and agitation is continued for one hour; after which 0.5 g of Lupersol 11 is added every hour over an 8-hour period until the residual 4-isopropenylpyridine level is less than 0.5%. The resulting poly(4-isopropenylpyridine) is recovered by filtering and drying in an 85% yield.

EXAMPLE 5

Poly(4-Isopropylpyridine) Sodium Carboxymethyl) Betaine Chloride

Into a 4-necked, 1-1 reaction kettle, equipped with a thermometer, reflux condenser, and a half-moon Teflon blade agitator, charge 177.3 g of poly(4-isopropenylpyridine) (Example 1, 40% solids in water). The batch is heated to 80° C. with agitation. A sodium 2-chlpropropionate solution is prepared by mixing 21.4 g of sodium hydroxide in 122.5 g deionized water and 58.1 g of 2-chloropropionic acid. The sodium 2-chloropropionate solution is added to the poly(4-isopropenylpyridine) solution and the mixture is heated to reflux and held at reflux temperature for 10 hours. 122.5 g of water is added with agitation. Then the isopropyl alcohol is removed under vacuum. The product is cooled and the solids is adjusted to 40±2%.

EXAMPLE 6

160 g of poly(4-isopropenylpyridine) (Example 1, 40% isopropanol solution) is charged into a kettle and heated to 80° C. with agitation. Then 23 g of crotonic acid is introduced and the mixture refluxed for 15 hours. Then 200 g of water is added with mixing. Then vacuum is applied to strip isopropyl alcohol. After cooling, the solids level is adjusted to 40±2%.

EXAMPLE 7

In a 1-l, 4-necked reaction kettle, equipped with a thermometer, reflux condenser, and a half-moon Teflon blade agitator, charge 60 g of poly(4-isopropenylpyridine) (Example 3) and 90 g of water. Agitate and heat the batch to 70° C. Prepare a sodium chloroacetate solution by mixing 59 g of sodium chloroacetate and 150 g of water. Add the prepared sodium chloroacetate solution and keep the mixture at 70° C. for 3 hours.

EXAMPLE 8

In a 1-l, 4-necked reaction kettle, equipped with a thermometer, reflux condenser, and a half-moon Teflon blade agitator, charge 60 g of poly(4-isopropenylpyridine) (Example 3) and 90 g of water. Agitate and heat the batch to 80° C. temperature. Prepare a sodium chloropropionate solution by mixing 18.6 g of sodium hydroxide in 120 g deionized water and 50 g of 2-chloropropionic acid. Add the sodium 2-choloropropionate solution, heat the mixture to reflux and,hold at reflux temperature for 10 hours.

Under normal these test conditions, the polymers of Examples 1–3 performed effectively as compared to other polymers known in the art for this purpose.

While the invention polymers has been described as an additive in a laundry detergent composition, it will be understood that they can be used in other applications which require anti-deposition properties. Accordingly, the water soluble polymers of the invention can be used effectively to inhibit dirt or soil redeposition in institutional, household and industrial cleaners, and textile applications, for example. Accordingly, the following is a list of suitable uses for the polymers and copolymers of the invention:

(a) fabric softener;
(b) soil anti-redeposition;
(c) digital printing ink application;
(d) textile dye stripping;
(e) textile dye strike rate control;
(f) flocculating agent;
(g) adhesive;
(h) ion-exchange/membranes;
(i) removal of trace metals from water (Hg, Cd, Cu, Ni)/water softening agent
(j) colloidal stabilization
(k) pumping oil from underground reservoirs
(l) personal care market, shampoos and hair conditioner
(m) cleaners and dish washing detergents, rinse aids;
(n) water treatment to prevent hot water salts from precipitation on sides of the wall; and
(o) pigment dispersion.

While the invention has been described with particular reference to certain embodiments thereof, it will be understood that changes and modifications may be made which are within the skill of the art. Accordingly, it is intended to be bound only by the following claims, in which:

What is claimed is:

1. A laundry detergent composition comprising at least 1% by weight of a surfactant selected from the group consisting of anionic, cationic or non-ionic surfactants and mixtures thereof; and a dye transfer inhibiting amount of a water soluble polymeric compound containing a quaternary nitrogen and a carboxylate salt or carboxylic acid group having dye complexing properties having the formula:

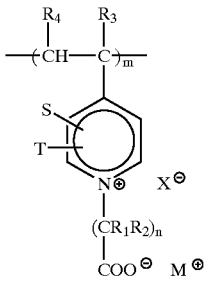

where m defines a repeating unit;

X is an anion;

$R_1$ and $R_2$ are independently hydrogen, alkyl or aryl;

$R_3$ and $R_4$ are independently hydrogen and alkyl, with the proviso that at least one of $R_3$ and $R_4$ is alkyl;

n is 1–5;

M is a cation or H; and copolymers thereof; and

S and T are independently hydrogen or alkyl.

2. A laundry detergent composition according to claim 1 in which X is a halide.

3. A laundry detergent composition according to claim 2 in which the polymer X is chloride or bromide.

4. A laundry detergent composition according to claim 3 in which said compound has a weight average molecular weight of about 5,000 to 1,000,000.

5. A laundry detergent composition according to claim 1 in which $R_1$ and $R_2$ are both hydrogen.

6. A laundry detergent composition according to claim 1 in which n is 1.

7. A laundry detergent composition according to claim 1 in which M is an alkali metal.

8. A laundry detergent composition according to claim 7 in which M is sodium or potassium.

9. A laundry detergent composition according to claim 1 in which M is H.

10. A laundry detergent composition, according to claim 1 in which m is 30–5000.

11. A laundry detergent composition according to claim 1 in which m is 100–1000.

12. A laundry detergent composition according to claim 1 in which the polymer is 25–100% quaternized.

13. A laundry detergent composition according to claim 12 in which the polymer is 75–100% quaternized.

14. A laundry detergent composition according to claim 1 in which the polymer is a water soluble copolymer with a polymerizable monomer.

15. A laundry detergent composition according to claim 14 in which the polymer is a water soluble copolymer with vinylpyrrolidone, vinyl caprolactam, vinyl imidazole, N-vinyl formamide or acrylamide.

16. A laundry detergent composition according to claim 1 in which the polymer is poly(4-isopropenylpyridine) sodium carboxymethyl betaine chloride.

17. A laundry detergent composition containing about 0.01–10% by weight of the polymer of claim 1.

18. A laundry detergent composition containing about 0.05–1% by weight of the polymer of claim 1.

19. A dye transfer inhibitor polymer which is a water soluble polymeric compound containing a quaternary nitrogen and a carboxylate salt or carboxylic acid group having dye complexing properties having the formula:

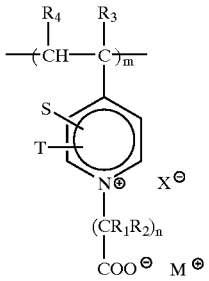

where m defines a repeating unit;

X is an anion;

$R_1$ and $R_2$ are independently hydrogen, alkyl or aryl;

$R_3$ and $R_4$ are independently hydrogen and alkyl, with the proviso that at least one of $R_3$ and $R_4$ is alkyl;

n is 1–5;

M is a cation or H; and copolymers thereof; and

S and T are independently hydrogen or alkyl.

20. A dye transfer inhibitor polymer according to claim 19 in which X is a halide.

21. A dye transfer inhibitor polymer according to claim 19 in which $R_1$ and $R_2$ are both hydrogen.

22. A dye transfer inhibitor polymer according to claim 19 in which n is 1.

23. A dye transfer inhibitor polymer according to claim 19 in which M is alkali metal or H.

24. A dye transfer inhibitor polymer according to claim 19 in which m is 30–5000.

25. A dye transfer inhibitor polymer according to claim 24 in which m is 100–1000.

26. A dye transfer inhibitor polymer according to claim 19 in which the polymer is 25–100% quaternized.

27. A dye transfer inhibitor polymer according to claim 19 in which the polymer is poly(4-isopropenylpyridine) sodium carboxymethyl betaine chloride.

* * * * *